US006481403B1

(12) United States Patent
Ashcraft et al.

(10) Patent No.: US 6,481,403 B1
(45) Date of Patent: Nov. 19, 2002

(54) CARBURETOR WITH PURGE PRIME SYSTEM

(75) Inventors: Jerry J. Ashcraft, Rio Rico, AZ (US); Jose Govea, Tuscon, AZ (US); Karl P. Richter, Sahuarita, AZ (US); Randy M. Sherman, Franklin, TN (US)

(73) Assignee: Walbro Corporation, Cass City, MI (US)

( * ) Notice: Subject to any disclaimer, the term of this patent is extended or adjusted under 35 U.S.C. 154(b) by 26 days.

(21) Appl. No.: 09/710,003

(22) Filed: Nov. 10, 2000

(51) Int. Cl.[7] ..... F02M 1/16

(52) U.S. Cl. ..... 123/179.11; 261/DIG. 8

(58) Field of Search ..... 123/179.9, 179.11, 123/179.12, 179.14; 261/DIG. 8, 36.2

(56) References Cited

U.S. PATENT DOCUMENTS 2,977,948 A * 4/1961 Kittler ..... 261/39.3
4,373,479 A * 2/1983 Billingsley et al. .... 123/179.11
5,250,233 A 10/1993 Swanson

* cited by examiner

*Primary Examiner*—Andrew M. Dolinar

(74) *Attorney, Agent, or Firm*—Reising, Ethington, Barnes, Kisselle, Learman & McCulloch, P.C.

(57) ABSTRACT

A diaphragm type carburetor which has a purge system to remove air and fuel vapor from the carburetor and to fill it with liquid fuel prior to starting an engine fed by the carburetor. The purge system has a primer valve actuated by moving a choke valve of the carburetor to its closed position to inject a small volume of liquid fuel into a throttle bore to provide a richer fuel and air mixture to the engine to facilitate starting it. Desirably, the small volume of liquid fuel is injected into the throttle bore in response to closing of the choke valve without requiring any additional steps such as depressing a button on the carburetor, to do so. Preferably, the choke valve is carried on a shaft which has at least one detent formed therein to provide a camming surface which actuates the primer valve as the choke valve is rotated from its open position to its closed position. Preferably, the choke valve shaft has a pair of detents. The primer valve is partially received by one detent when the choke valve is fully opened to close the primer valve and prevent any fluid flow therethrough. A second detent partially receives the primer valve to also close the primer valve after the choke valve has been moved to its fully closed position. The camming surface is disposed between the two detents relative to the movement of the choke valve to temporarily open the primer valve and inject the desired quantity of liquid fuel into the throttle bore to assist starting the engine when the choke valve is moved between its open and closed positions.

14 Claims, 3 Drawing Sheets

CARBURETOR WITH PURGE PRIME SYSTEM

FIELD OF THE INVENTION

This invention relates generally to carburetors and more particularly to diaphragm type carburetors.

BACKGROUND OF THE INVENTION

Typically, carburetors have been used to supply a fuel and air mixture to both four stroke and two stroke internal combustion engines. For many applications where small two stroke engines are utilized, such as hand held power chainsaws, weed trimmers, leaf blowers, garden equipment and the like, carburetors with both a diaphragm fuel delivery pump and diaphragm fuel metering system have been utilized. To start an engine which has its fuel supplied through such a carburetor, a purge system must be actuated several times to remove air from the carburetor and to fill desired fuel passages and chambers with liquid fuel to facilitate starting the engine. A choke valve must also be moved to its closed position at least substantially preventing air flow through a throttle bore of the carburetor. Thereafter, the engine starter mechanism must be actuated at least once and usually several times until a "false start" event occurs. This false start event occurs when combustion occurs and the engine initially turns over or starts but ceases to operate or dies soon thereafter due to the closed choke valve which prevents a sufficient air flow to the engine for its continued operation. After the false start event, the choke valve is manually moved to its open position and the starter mechanism again actuated to start the engine and provide sufficient air to the engine for its continued operation after it is started.

This multi-step starting procedure is somewhat complicated and difficult for the average consumer to easily and properly perform. In particular, many consumers have difficulty recognizing the false start event and therefore, they attempt to start the engine after the false start event with the choke valve closed. With the choke valve closed, as previously mentioned, there is an insufficient air supply to the engine for its continued operation and hence, even if the engine is initially started by this procedure it soon thereafter ceases to operate.

Some conventional carburetors utilize a priming system which injects a small quantity of liquid fuel into the throttle bore in response to the depression of a separate button on the carburetor to discharge the liquid fuel into the throttle bore. The liquid fuel provided into the throttle bore is desirable to provide a richer fuel and air mixture to facilitate starting the engine.

SUMMARY OF THE INVENTION

A diaphragm type carburetor which has a purge system to remove air and fuel vapor from the carburetor and to fill it with liquid fuel prior to starting an engine fed by the carburetor. The system has a primer valve actuated by moving a choke valve of the carburetor to its closed position to inject a small volume of liquid fuel into a throttle bore to provide a richer fuel and air mixture to the engine to facilitate starting it. Desirably, the small volume of liquid fuel is injected into the throttle bore in response to closing of the choke valve without requiring any additional steps such as depressing a button on the carburetor, to do so. Preferably, the choke valve is carried on a shaft which has a cam surface which actuates the primer valve as the choke valve is rotated from its open position to its closed position. Preferably, the choke valve shaft also has a pair of detents which close the primer valve and releasably retain the choke in its open and closed positions respectively. The primer valve is partially received in a recess of one detent when the choke valve is fully opened to close the primer valve and prevent any fluid flow therethrough. A recess of a second detent partially receives the primer valve to also close the primer valve after the choke valve has been moved to its fully closed position. The camming surface is disposed between the two detent recesses relative to the movement of the choke valve to temporarily open the primer valve and inject the desired quantity of liquid fuel into the throttle bore to assist starting the engine when the choke valve is moved between its open and closed positions.

Desirably, a purge system of the carburetor draws fuel from a fuel tank into a primer reservoir which has an overflow outlet leading back to the fuel tank and a diaphragm biased by a spring tending to reduce the volume of the primer reservoir and constructed to pressurize the fuel therein. Therefore, when the primer valve is opened as the choke valve is moved to its closed position, the fuel under pressure in the primer reservoir rushes past the temporarily opened primer valve and is injected into the throttle bore.

Objects, features and advantages of this invention include providing a carburetor which facilitates starting the engine, provides a quantity of liquid fuel into a throttle bore of the carburetor before starting of the engine to prime the carburetor, is self priming when the choke valve is moved to its closed position without requiring any additional steps during the starting procedure, maintains the primer valve closed when the choke valve is in its open and closed positions to prevent flooding the engine even if the air purge system of the carburetor is actuated after the choke valve is closed, permits a sufficient air flow through the throttle bore even when the choke valve is closed to permit sustained operation of the engine after initial starting even with the choke valve closed, is of relatively simple design and economical manufacture and assembly, is reliable, durable and has a long in service useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
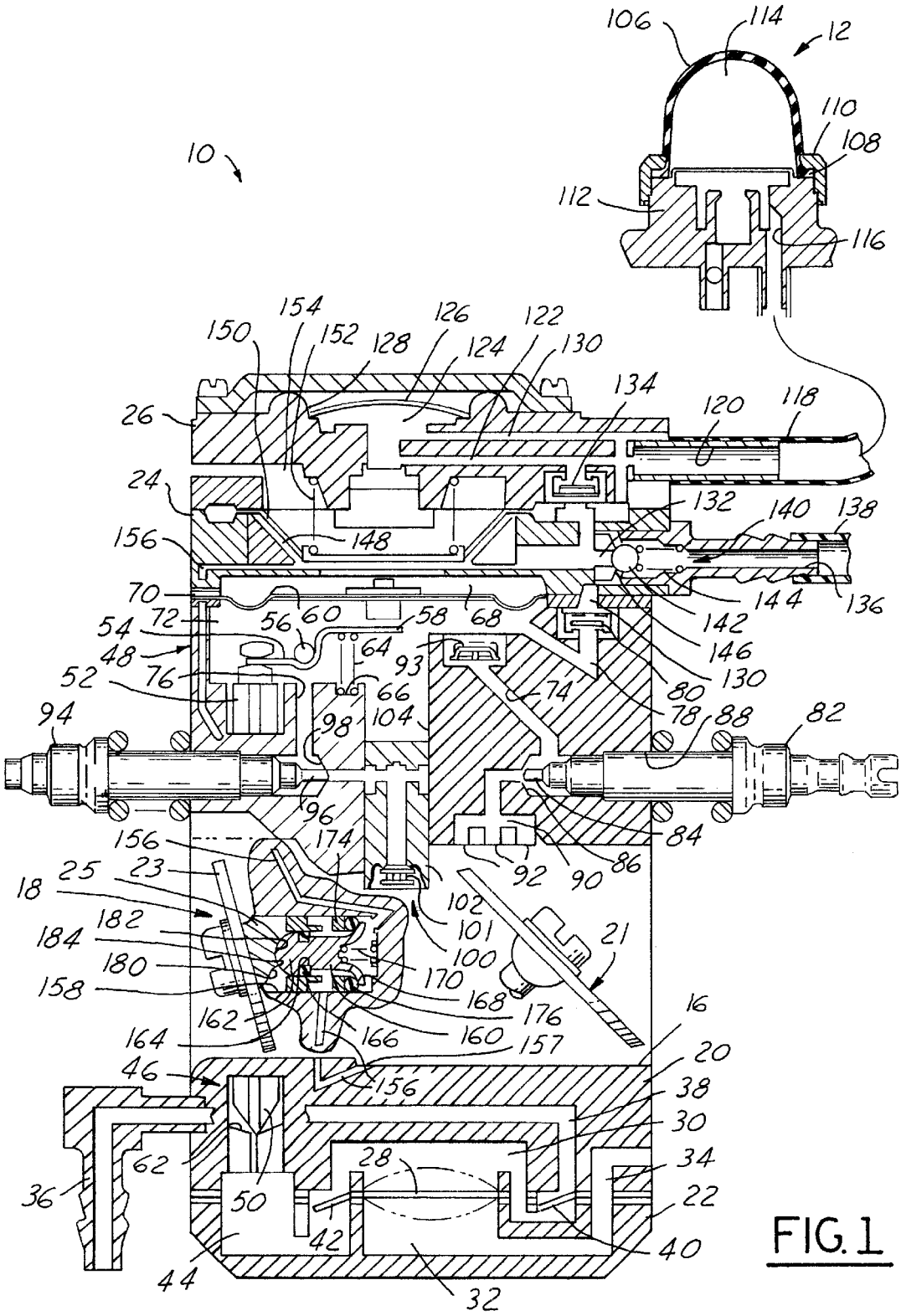
FIG. 1 is a cross sectional view of a diaphragm type carburetor embodying this invention and having a purge mechanism mounted remotely of the carburetor.

Referring in more detail to the drawings, FIG. 1 illustrates a diaphragm type carburetor 10 having a remote purge mechanism 12 and a primer valve 14 communicating with a fuel and air mixing passage 16 of the carburetor 10 and actuated by movement of a choke valve 18 from its open position to its closed position to inject a small quantity of liquid fuel into the fuel and air mixing passage 16. The liquid fuel injected into the fuel and air mixing passage 16 provides a richer fuel and air mixture to the engine which is desirable for initial starting of the engine.

The carburetor 10 has a body 20 through which the fuel and air mixing passage 16 is formed. A throttle valve 21 is received in the fuel and air mixing passage and is rotatable between idle and wide open positions to control air and fuel flow through the carburetor 10 and to the engine on which the carburetor 10 is used. The choke valve 18 is upstream of the throttle valve 21 and has a valve head 23 mounted on a shaft 25 extending into the fuel and air mixing passage 16. The shaft 25 is rotatable to move the valve head 23 between an open position permitting a substantially unrestricted or free flow of air through the fuel and air mixing passage 16 and a closed position at least substantially restricting the flow of air through the fuel and air mixing passage 16.

Desirably, the valve head 23 has a diameter slightly smaller than the diameter of the portion of the fuel and air mixing passage in which it is received so that even when the choke valve is in its closed position, sufficient air may pass through the fuel and air mixing passage 16 for idle operation of the engine. This permits the engine to operate after it is initially started and the choke valve is still in its closed position necessary to start the engine. Alternatively, the choke valve head 23 may have one or more holes therethrough to permit the desired air flow when the choke valve is closed.

The carburetor 10 has a main body 20 with a fuel pump plate 22 at one end and an intermediate plate 24 sandwiched between the other end of the carburetor body 20 and an air purge plate 26. A fuel pump diaphragm 28 is trapped between the fuel pump plate 22 and the carburetor body 20 to define a fuel pump chamber 30 on one side of the diaphragm 28 and a pressure pulse chamber 32 on the other side. The pressure pulse chamber 32 opens to a pressure pulse passage 34 extending to the exterior of the carburetor body 20 and communicates with a crankcase chamber of the engine in assembly.

A negative pressure pulse communicated from the engine crankcase to the pressure pulse chamber 32 displaces the fuel pump diaphragm 28 in a direction tending to increase the volume of the fuel pump chamber 30 thereby drawing fuel from a fuel reservoir through an inlet fitting 36 and inlet passage 38 formed through the carburetor body 20. The decrease in pressure in the fuel pump chamber 30 opens an inlet valve 40, which is preferably a flap type valve integral with the diaphragm 28, to permit fluid flow into the fuel pump chamber 30. Thereafter, a positive pressure pulse from the engine crankcase displaces the fuel pump diaphragm 28 in a direction tending to decrease the volume of the fuel pump chamber 30 thereby increasing the pressure within the fuel pump chamber 30. The increased pressure in the fuel pump chamber 30 opens an outlet valve 42, which is also preferably a flap type valve integral with the fuel pump diaphragm 28, to permit fluid flow through the outlet valve 42 into an outlet chamber 44 which leads to an inlet valve 46 of a fuel metering system 48 of the carburetor 10.

The fuel metering system 48 has a diaphragm controlled inlet valve 46 with a needle shaped valve head 50 and a shank 52 which is actuated by a lever arm 54 connected at one end to the shank 52, fulcrumed between its ends on a pin 56 and having a control finger 58 actuated at its free end by a fuel metering diaphragm 60. The inlet valve 46 is yieldably urged to its closed position bearing on a valve seat 62 by a coil spring 64 and is actuated to an open position by movement of the diaphragm 60. The coil spring 64 is received in a pocket 66 in the body 20 and bears on the finger 58 of the lever arm 54. The fuel metering diaphragm 60 is trapped between the carburetor body 20 and the intermediate plate 24 to define a dry or air chamber 68 on one side communicating with the atmosphere through a vent opening 70 and a fuel metering chamber 72 on the other side of the diaphragm 60 communicating with the inlet valve 46.

In use, as fuel is drawn from the metering chamber 72 the quantity of fuel therein will decrease and a differential pressure across the metering diaphragm 60 will move the lever arm 54 against the bias of the spring 64 in a clockwise direction (as viewed in FIG. 1), to open the inlet valve 46 and allow pressurized fuel from the fuel pump to enter the metering chamber 72. As the metering chamber 72 fills with additional fuel, the pressure therein increases and the fuel metering diaphragm 60 will tend to move the lever arm 54 counterclockwise to close the inlet valve 46 and thereby regulate the pressure of the fuel within the metering chamber 72.

Fuel leaves the fuel metering chamber 72 through both a low speed fuel outlet 74 and a high speed fuel outlet 76. Air, fuel vapor or liquid fuel may also leave the metering chamber 72 through a purge outlet 78 normally closed by a check valve 80 during an air purge process of the carburetor 10. Fuel flow through the low speed fuel outlet 74 is controlled by an adjustable low speed needle valve 82 which has a needle shaped valve head 84 received in an annular valve seat 86 to define an annular flow area adjustable in size by advancing or retracting the valve head 84 relative to the valve seat 86. This may be done in a conventional manner by rotating the needle valve 82 in a threaded bore 88 in which it is received in the carburetor body 20.

Fuel which passes through the flow area of the low speed needle valve 82 is distributed to a fuel progression pocket 90 which communicates with a plurality of spaced apart fuel jets 92 which open into the fuel and air mixing passage 16. Fuel flows out of each jet 92 and into the fuel and air mixing passage 16 in response to a pressure differential across the fuel jets 92. Desirably, at least one fuel jet 92 is disposed upstream of the throttle valve 21 when it is in its idle position and at least one fuel jet 92 is disposed downstream of the throttle valve 21 in its idle position. As the throttle valve 21 is moved from its idle position toward its wide open throttle position, an engine manifold vacuum pressure communicated with the fuel and air mixing passage 16 is increasingly applied to the fuel jets 92 to draw fuel therethrough into the fuel and air mixing passage 16 to be mixed with air flowing through the passage 16 and provide a rich fuel and air mixture to the engine. A reverse fluid flow from the fuel and air mixing passage 16 to the fuel metering chamber 72 through the fuel jets 92 is prevented by a check valve 93 in the low speed fuel outlet.

Fuel flow from the fuel metering chamber 72 through the high speed fuel outlet 76 is controlled by an adjustable high speed needle valve 94. The high speed needle valve 94 has a needle shaped valve head 96 which cooperates with an annular valve seat 98 to define an annular flow area which is adjustable in size by advancing or retracting the valve head 96 of the needle valve 94 relative to the valve seat 98. Fuel which flows through the flow area of the high speed needle valve 94 is directed to a high speed fuel nozzle 100 which may be defined in an insert 102 press fit in a bore 104 of the carburetor body 20. A check valve 101 prevents back bleeding of air through the nozzle 100. The high speed fuel nozzle 100 is preferably disposed in the venturi portion of the fuel and air mixing passage 16 and fuel is drawn therethrough in response to a pressure differential across the nozzle 100. When the throttle valve 21 is in its wide open position, engine manifold vacuum pressure is applied to the fuel nozzle 100 to draw fuel therethrough and in addition, the flow of air through the venturi creates an additional pressure drop to also create a pressure drop across the nozzle 100 to draw fuel therethrough.

The air purge mechanism 12 has a flexible bulb 106 with a radially outwardly extending rim 108 trapped between a cover 110 and a body 112 which is mounted exteriorally of the carburetor 10 to define a bulb chamber 114. An opening 116 through the body 112 communicates with the bulb chamber 114 and a fluid conduit 118 communicates this opening 116 with a fluid fitting 120 carried by the air purge plate 26. The fluid fitting 120 leads to a first purge passage 122 leading to a purge chamber 124 closed by a plug 126 press fit into a recess 128 in the purge plate 26. The purge chamber 124 leads to a second purge passage 130 which communicates with the fuel metering chamber 72 through its purge outlet 78 and the check valve 80 which permits fluid flow from the metering chamber 72 to the second purge passage 130 when a sufficient pressure differential exists across the check valve 80 and prevents the reverse flow of fuel from the second purge passage 130 to the fuel metering chamber 72. Desirably, the check valve 80 closes the purge outlet 78 in normal operation of the engine and carburetor 10 to reduce the likelihood of leaks from the fuel metering chamber 72 which would adversely impact the operation of the carburetor 10.

The first purge passage 122 communicates with a primer overflow passage 132 through a second or primer inlet check valve 134 which permits fluid flow from the first purge passage 122 to the primer overflow passage 132 but prevents the reverse flow of fluid therethrough. The primer overflow passage 132 leads to an outlet fitting 136 carried by the intermediate plate 24 which communicates with the fuel tank through a suitable conduit 138. Fluid flow through the outlet fitting 136 is controlled by a check valve 140 having a valve head 142 biased by a spring 144 against a valve seat 146 to prevent flow from the outlet fitting 136 to the primer overflow passage 132 and to permit reverse flow from the primer overflow passage 132 through the outlet fitting 136 only when the pressure within the primer overflow passage 132 is sufficient to displace the valve head 142 from the valve seat 146.

The primer overflow passage 132 opens to a primer reservoir 148 defined between the intermediate plate 24 and a primer diaphragm 150 trapped between the purge plate 26 and intermediate plate 24. A spring 152 in an atmospheric chamber 154 on the other side of the primer diaphragm 150 yieldably biases the diaphragm 150 in a direction tending to decrease the volume of the primer reservoir 148. The primer reservoir 148 in turn is open to a fuel primer passage 156 which extends through the carburetor body 20 and opens into the fuel and air mixing passage 16 via an outlet 157 between the choke valve 18 and the throttle valve 21. Flow through the fuel primer passage 156 is controlled by the primer valve 14 received in a pocket 158 in the carburetor body 20.

Figure 2:
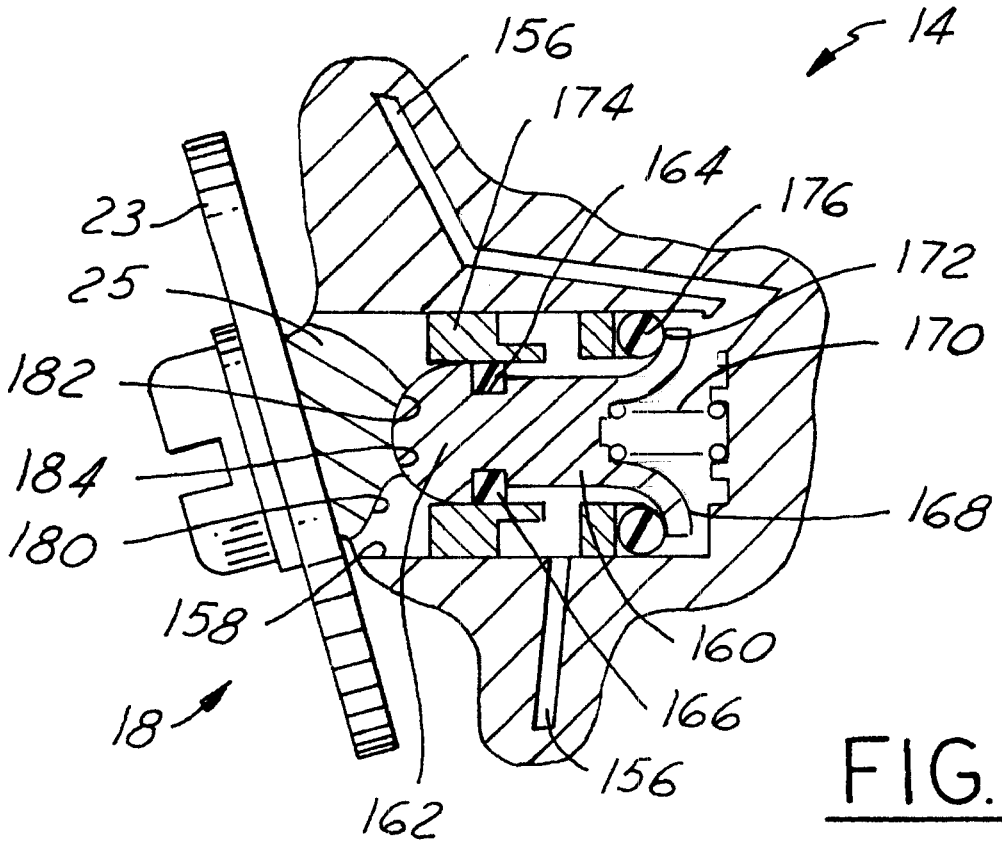
FIG. 2 is an enlarged fragmentary view of a primer valve of the carburetor of FIG. 1.

As best shown in FIG. 2, the primer valve 14 has a valve body 160 slidably received in an annular insert 174 preferably press fit in the pocket 158 to both provide a seal between them and axially locate the insert in the pocket. The valve body 160 has a generally dome shaped end 162 and an annular groove 164 receiving a sealing member 166 such as on O-ring to prevent fluid flow from the primer passage 156 out of the pocket 158 beyond the sealing member 166. A valve head 168 of the primer valve 14 is yieldably biased by a spring 170 onto a valve seat 172 of the annular insert 174 in the pocket 158 to prevent fluid flow through the primer valve 14. An O-ring 176 preferably defines the valve seat 172 and is disposed between the pocket 158 and insert 174 to prevent fuel leakage from the pocket 158. As shown, the valve head 168 comprises a radially outwardly extending rim of the valve body 160.

The dome shaped end 162 of the valve body 160 extends into contact with a shaft 25 of the choke valve 18. The choke valve shaft 25 has a pair of detents 180, 182 formed therein with a first detent 180 adapted to be aligned with the end 162 of the valve body 160 when the choke valve 18 is in its open position for normal operation of the engine and a second detent 182 adapted to be aligned with the end 162 of the valve body 160 when the choke valve 18 is in its closed position, as shown in FIG. 1, to facilitate starting the engine. In between the detents 180, 182 is a camming surface 184 which engages the end 162 of the valve body 160 during a portion of the rotation of the choke valve shaft 25 between the open and closed positions of the choke valve 18 to separate the valve head 168 from the valve seat 172 and thereby open the valve 14 to permit fluid flow through the primer valve 14 to the fuel and air mixing passage 16. When the end 162 of the valve body 160 is aligned with and received in either of the detents 180, 182 of the choke valve shaft 25, the valve head 168 is urged against the valve seat 172 by spring 170 to close the valve 14 to prevent fluid flow therethrough.

To start an engine utilizing the carburetor 10, the choke valve 18 is initially maintained in its open position and if desired, the throttle valve 21 is moved to a "fast idle" position between its idle and wide open positions to permit a greater air flow through the passage 16 than when it is in its idle position to increase the engine speed (i.e. fast idle) and facilitate warming up the engine. The purge bulb 106 is depressed to force any fluid in the bulb chamber 114, fluid conduit 118 or first purge passage 122 through the check valve 134 into the primer overflow passage 132. This fluid enters the primer reservoir 148, fuel primer passage 156 and is prevented from entering the fuel and air mixing passage 16 by the closed primer valve 14. As the bulb 106 is released, a vacuum is generated as the volume of the bulb chamber 114 is increased due to the check valve 134 at the primer overflow passage 132, which prevents fluid flow from the primer reservoir 148 to the first purge passage 122, and the check valves 101, 93, respectively, at the high speed fuel nozzle 100 and in the low speed fuel outlet 74 of the fuel metering chamber 72 which prevent air or fluid from being drawn from the fuel and air mixing passage 16 back into the fuel metering chamber 72. The vacuum generated by the expanding bulb 114 draws the check valve 80 at the purge outlet 78 of the fuel metering chamber 72 to its open position, decreases the pressure within the fuel metering chamber 72 and thereby opens the inlet valve 46 to permit fuel to flow from the fuel source or tank through the fuel pump, the fuel metering chamber 72, second purge passage 130 and the purge outlet check valve 80.

It may take multiple depressions and releases of the air purge bulb 106 to draw fuel from the fuel pump to the air purge mechanism 12. In any event, when liquid fuel is drawn into the first air purge passage 122 or into the bulb chamber 114, subsequent depression of the bulb 106 forces this liquid fuel through the check valve 134 into the primer overflow passage 132, the primer reservoir 148 and into the fuel primer passage 156 to the primer valve 14. Should the pressure of the fluid in the primer reservoir 148 and primer overflow passage 132 exceed the predetermined maximum pressure, the check valve 140 at the outlet fitting 136 will be opened to permit some fluid to escape to the fuel tank until the pressure is reduced sufficiently such that the check valve 140 closes. The spring 152 biasing the primer diaphragm 150 and the spring 144 bearing on the valve head 142 of the check valve 140 maintain a desired fuel pressure within the primer reservoir 148 and fuel primer passage 156.

Next, the choke valve 18 is rotated from its open position to its closed position, as shown in FIG. 1, to at least substantially restrict air flow through the fuel and air mixing passage 16. The choke valve 18 is rotated via its shaft 25. As the choke valve shaft 25 rotates, it moves the first detent 180 out of registry with the end 162 of the valve body 160 and brings the camming surface 184 into engagement with the end 162 of the valve body 160. When the camming surface 184 engages the end 162 of the valve body it slidably displaces the valve body 160 to separate the valve head 168 from the valve seat 172 and to permit flow of the pressurized fluid in the fuel primer passage 156 to pass through the open primer valve 14 and to be injected into the fuel and air mixing passage 16 through a fuel primer outlet 190 therein. Continued rotation of the choke valve shaft 25 to rotate the choke valve 18 to its closed position rotates the camming surface 184 out of engagement with the valve body 160 and rotates the second detent 182 into alignment with the valve body end 162 such that the spring 170 forces the valve head 168 once again into engagement with the valve seat 172 to close the valve 14 and prevent additional fuel flow through the fuel primer passage 156. Thereafter, the starter mechanism of the engine is activated to start the engine. The primer fuel injected into the fuel and air mixing passage 16 provides a richer fuel and air mixture which facilitates starting of the engine.

Once the engine starts it may continue to operate because the choke valve 18 does not completely close off the fuel and air mixing passage 16. Rather, the choke valve 18 merely significantly restricts air flow therethrough to increase the magnitude of the manifold vacuum pressure within the fuel and air mixing passage 16 upstream thereof. This increases the fuel flow drawn through the high speed fuel nozzle 100 and low speed fuel jets 92 to provide a rich air and fuel mixture to the engine and thereby facilitate starting and warming up the engine. After the engine has run for a set period of time to permit the engine to warm up to a suitable operating temperature, typically 15 to 30 seconds, the throttle may be actuated to open the throttle valve 21 and simultaneously rotate the choke valve 10 to its fully open position for normal operation of the engine. Rotation of the choke valve 18 moves the end 162 of the valve body 160 from the second detent 182 to the first detent 180, temporarily opens the primer valve 14 again and may deliver a small amount of additional primer fuel into the fuel and air mixing passage 16 which is consumed by the engine. After the excess fuel is burned off, the engine is set for normal operation.

Accordingly, a carburetor 10 is provided which facilitates providing a quantity of additional fuel to the engine to facilitate starting the engine which does not require the consumer to perform any additional steps beyond the activation of the purge mechanism 28 and choke valve 18 required to start the engine. Desirably, rotation of the choke valve 18 from its open position to its starting or closed position automatically discharges the desired quantity of primer fuel through a primer valve 14 into the fuel and air mixing passage 16 of the carburetor 10. Further, if desired to provide easier access to it, the purge mechanism 28 may be mounted remotely of the carburetor.

Figure 3:
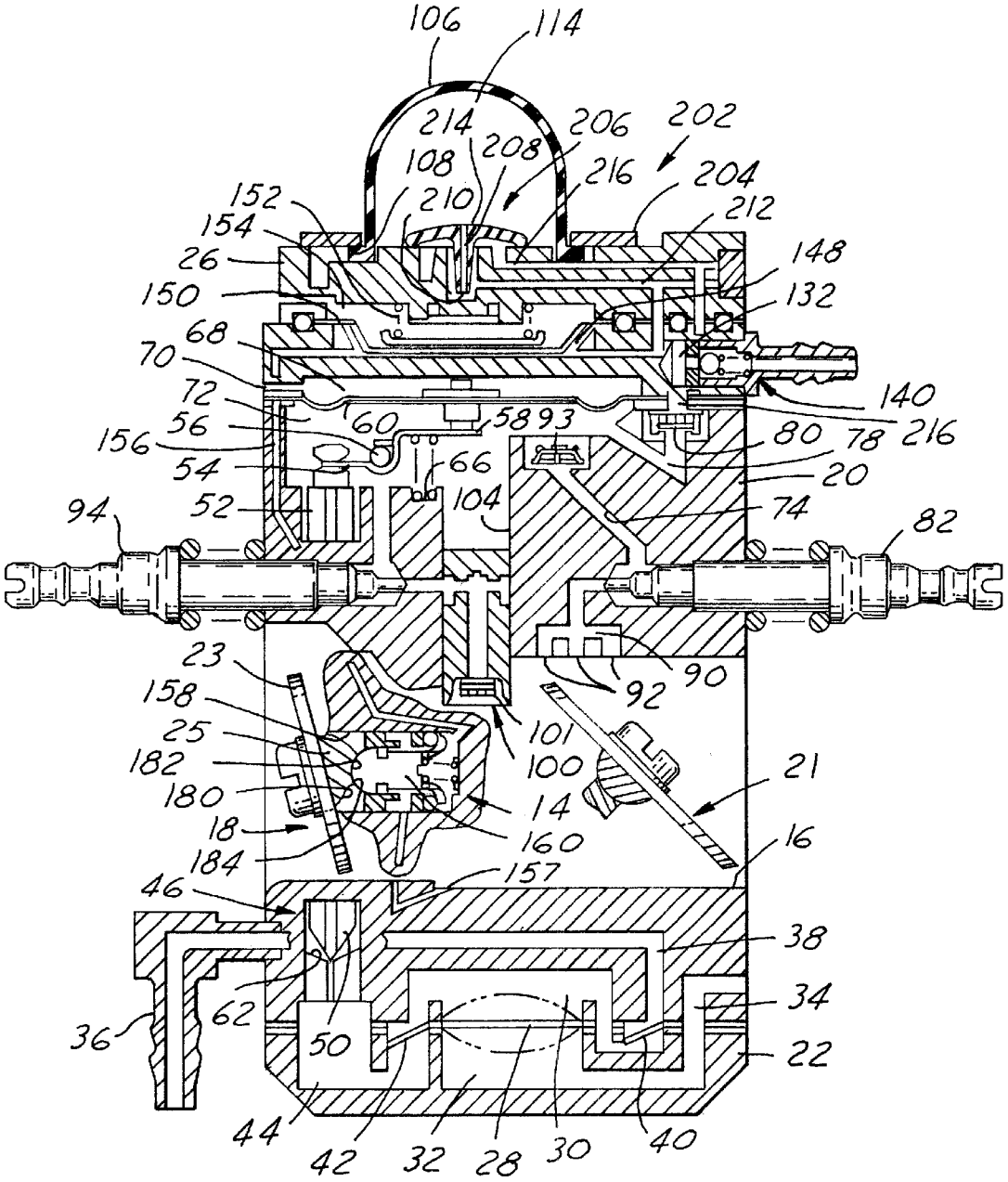
FIG. 3 cross sectional view of a carburetor according to a second embodiment of the invention having a purge mechanism mounted on the carburetor.

FIG. 3 illustrates a second embodiment of a carburetor 200 according to the present invention having a purge mechanism 202 mounted on the purge plate 26 of the carburetor body 20. The outwardly extending rim 108 of the bulb 106 is trapped between a cover 204 and the purge plate 26. An umbrella type check valve 206 is disposed within the bulb chamber 114 to control the flow of fluid into and out of the bulb chamber 114. When the bulb 106 is depressed, any fluid in the bulb chamber 114 is forced through a central outlet 208 of the check valve which is normally closed at one end 210 to prevent fluid flow into the bulb chamber 114. Fluid discharged through the outlet 208 flows to a purge outlet passage 212 leading to the primer reservoir 148 and overflow passage 132. When the bulb 106 is released, the volume of the bulb chamber 114 increases thereby creating a vacuum which displaces a flap type valve head 214 of the check valve 206 to permit fluid in a purge inlet passage 216 to be drawn into the bulb chamber 114. Valve head 214 prevents a reverse fluid flow from the bulb chamber 114 to the purge inlet passage 216. Purge inlet passage 216 leads to the purge outlet 78 of the fuel metering chamber 72 to draw fluid from the chamber 72 as described with reference to the first embodiment carburetor 10. Thus, the umbrella type check valve 206 checks flow both into and out of the bulb chamber 114 and functions in the same manner as the both the check valve 80, at the purge outlet 78 of the fuel metering chamber 72, and the check valve 134 at the primer overflow passage 132. In all other aspects, the carburetor 200 is constructed and functions in the same manner as the first embodiment carburetor 10 and hence, like reference numbers have been applied to like parts and the construction and operation of carburetor 200 will not be described further.

What is claimed is:

1. A carburetor for an internal combustion engine comprising:

a body having a fuel and air mixing passage extending therethrough;

a throttle valve in the fuel and air mixing passage movable between idle and wide open positions to control at least in part the flow of air through the fuel and air mixing passage;

a choke valve shaft carried by the body;

a choke valve head in the fuel and air mixing passage upstream of the throttle valve, carried by the choke valve shaft and movable between open and closed positions;

a cam carried by the choke valve shaft;

a primer fuel passage adapted to receive a supply of fuel and being communicated with the fuel and air mixing passage;

a primer valve carried by the body in communication with the primer fuel passage and having a valve seat and a valve head yieldably biased to a closed position on the valve seat to prevent fluid flow through the primer valve and movable by the cam to an open position spaced from the valve seat in response to movement of the choke valve from its open position to its closed position to permit fluid flow through the primer valve and to provide a quantity of fuel from the primer fuel passage into the fuel and air mixing passage to facilitate starting an engine with which the carburetor is used; and at least one detent carried by the choke valve shaft and configured to permit the primer valve head to be in its closed position when the choke valve is in its open position.

2. The carburetor of claim 1 which also comprises a second detent formed in the choke valve shaft and adapted to receive said portion of the primer valve when the choke valve is in its closed position to permit the primer valve to be in its closed position with its valve head bearing on its valve seat.

3. A carburetor for an internal combustion engine comprising:

a body having a fuel and air mixing passage extending therethrough;

a throttle valve in the fuel and air mixing passage movable between idle and wide open positions to control at least in part the flow of air through the fuel and air mixing passage;

a choke valve shaft carried by the body, a choke valve head carried by the choke valve shaft in the fuel and air mixing passage upstream of the throttle valve and movable between open and closed positions;

a primer fuel passage adapted to receive a supply of fuel and being communicated with the fuel and air mixing passage;

a primer valve carried by the body in communication with the primer fuel passage and having a valve seat and a valve head yieldably biased to a closed position on the valve seat to prevent fluid flow through the primer valve and movable to an open position spaced from the valve seat in response to movement of the choke valve from its open position to its closed position to permit fluid flow through the primer valve and to provide a quantity of fuel from the primer fuel passage into the fuel and air mixing passage to facilitate starting an engine with which the carburetor is used;

a camming surface carried by the choke valve shaft, engageable with the primer valve during at least a portion of the rotation of the choke valve from its open position to its closed position to at least temporarily open the primer valve; and at least one detent carried by the choke valve shaft with a portion of the primer valve received in the detent when the choke valve is in its open position to permit the primer valve to be in its closed position with its valve head bearing on its valve seat and wherein the camming surface is disposed adjacent to said at least one detent to engage the primer valve as the choke valve is rotated to its closed position and move the primer valve head off of the primer valve seat and thereby permit fluid flow through the primer valve.

4. The carburetor of claim 3 which also comprises a second detent formed in the choke valve shaft and adapted to receive said portion of the primer valve when the choke valve is in its closed position to permit the primer valve to be in its closed position with its valve head bearing on its valve seat.

5. The carburetor of claim 3 wherein the primer valve has an annual valve seat, a valve body with an end constructed to be engaged by the choke valve during at least a portion of the movement of the choke valve from its open position to its closed position, a radially outwardly extending valve head selectively engageable with the valve seat and a spring yieldably biasing the valve head onto the valve seat.

6. The carburetor of claim 5 which also comprises a pocket formed in the body in which the primer valve is received and an annular insert received in the body and defining the valve seat.

7. A carburetor for an internal combustion engine comprising:

a body having a fuel and air mixing passage extending therethrough;

a throttle valve in the fuel and air mixing passage movable between idle and wide open positions to control at least in part the flow of air through the fuel and air mixing passage;

a choke valve shaft carried by the body, a choke valve head carried by the choke valve shaft in the fuel and air mixing passage upstream of the throttle valve and movable between open and closed positions;

a primer fuel passage adapted to receive a supply of fuel and being communicated with the fuel and air mixing passage;

a primer valve carried by the body in communication with the primer fuel passage and having a valve seat and a valve head yieldably biased to a closed position on the valve seat to prevent fluid flow through the primer valve and movable to an open position spaced from the valve seat in response to movement of the choke valve from its open position to its closed position to permit fluid flow through the primer valve and to provide a quantity of fuel from the primer fuel passage into the fuel and air mixing passage to facilitate starting an engine with which the carburetor is used;

a camming surface carried by the choke valve shaft, engageable with the primer valve during at least a portion of the rotation of the choke valve from its open position to its closed position to at least temporarily open the primer valve; and a primer diaphragm carried by the body and defining a primer reservoir on one side of the diaphragm communicating with the primer fuel passage and a supply of liquid fuel to provide fuel into the primer fuel passage, and a primer inlet check valve between the supply of liquid fuel and the primer reservoir to permit fluid flow into the primer reservoir and prevent the reverse flow of fluid therethrough.

8. The carburetor of claim 7 which also comprises a camming surface on the choke valve engageable with the primer valve during at least a portion of the rotation of the choke valve from its open position to its closed position to at least temporarily open the primer valve.

9. The carburetor of claim 8 wherein the choke valve has a valve head received for rotation in the fuel and air mixing passage and a choke valve shaft connected to the valve head with the camming surface being carried by the choke valve shaft.

10. The carburetor of claim 7 which also comprises a spring carried by the body and yieldably biasing the primer diaphragm in a direction tending to reduce the volume of the primer reservoir to resist displacement of the primer diaphragm when it is acted on by fluid in the primer reservoir and thereby pressurize the fluid in the primer reservoir, at least under certain fluid conditions within the primer reservoir, to provide pressurized fuel in the primer fuel passage when the primer valve is closed so that when the primer valve is opened, at least some of the fuel in the primer fuel passage will flow through the primer valve to the fuel and air mixing passage.

11. The carburetor of claim 10 which also comprises a primer overflow passage communicating the primer reservoir with the exterior of the primer reservoir and an overflow check valve in the primer overflow passage to prevent fluid flow into the primer reservoir therethrough and to permit fluid flow out of the primer reservoir through the primer overflow passage when the pressure within the primer reservoir exceeds a predetermined maximum pressure.

12. The carburetor of claim 7 which also comprises a purge mechanism having a purge bulb defining a bulb chamber communicating with the primer reservoir through at least one fluid passage to provide at least some of the fluid within said at least one fluid passage into the primer reservoir through the primer inlet check valve when the purge bulb is depressed and to draw fluid through the carburetor to said at least one fluid passage when the purge bulb is released and the volume of the bulb chamber increases.

13. The carburetor of claim 12 wherein the purge bulb is carried by a purge body disposed remotely from the carburetor body.

14. The carburetor of claim 12 wherein the purge bulb is carried by the carburetor body.

* * * * *